US007937031B2

(12) United States Patent
Inui et al.

(10) Patent No.: US 7,937,031 B2
(45) Date of Patent: May 3, 2011

(54) TRANSFER BELT DEVICE AND IMAGE FORMING APPARATUS PROVIDED WITH THE SAME

(75) Inventors: Hiroshi Inui, Osaka (JP); Yoshiaki Tashiro, Osaka (JP)

(73) Assignee: Kyocera Mita Corporation (JP)

( * ) Notice: Subject to any disclaimer, the term of this patent is extended or adjusted under 35 U.S.C. 154(b) by 150 days.

(21) Appl. No.: 12/357,991

(22) Filed: Jan. 22, 2009

(65) Prior Publication Data

US 2009/0190971 A1 Jul. 30, 2009

(30) Foreign Application Priority Data

Jan. 28, 2008 (JP) ..... 2008-015935

(51) Int. Cl.
*G03G 15/01* (2006.01)

(52) U.S. Cl. ..... 399/299; 399/302

(58) Field of Classification Search ..... 399/121, 399/298, 299, 302, 308
See application file for complete search history.

(56) References Cited

U.S. PATENT DOCUMENTS

| | | | | |
|---|---|---|---|---|
| 5,765,082 | A * | 6/1998 | Numazu et al. | 399/299 |
| 6,029,023 | A * | 2/2000 | Munemori et al. | 399/299 X |
| 6,061,542 | A * | 5/2000 | Minami et al. | 399/299 |
| 7,561,840 | B2 | 7/2009 | Morimoto et al. | |
| 7,664,444 | B2 * | 2/2010 | Mochizuki | 399/302 |
| 7,672,605 | B2 * | 3/2010 | Kayahara et al. | 399/299 X |

FOREIGN PATENT DOCUMENTS

| | | |
|---|---|---|
| CN | 1864107 | 11/2006 |
| JP | 2002-99132 | 4/2002 |

* cited by examiner

*Primary Examiner* — Sandra L Brase
(74) *Attorney, Agent, or Firm* — Gerald E. Hespos; Michael J. Porco

(57) ABSTRACT

An transfer belt device includes a roller support supporting transfer rollers, a cam driving shaft having a cam, the cam having capability of swinging the roller support to move the transfer rollers toward and apart from color photosensitive drums to thereby switch a transfer belt and the color photosensitive drums between a state where the transfer belt is in contact with the color photosensitive drums and a state where the transfer belt is out of contact with the color photosensitive drums, a tension roller kept in contact with a surface of the transfer belt to exert tension on the transfer belt, and a pivotal axis on which the tension roller is swingably supported, the pivotal axis being common with the cam driving shaft.

8 Claims, 5 Drawing Sheets

TRANSFER BELT DEVICE AND IMAGE FORMING APPARATUS PROVIDED WITH THE SAME

BACKGROUND OF THE INVENTION

1. Field of the Invention

The present invention relates to a transfer belt device and an image forming apparatus provide with the same.

2. Description of the Related Art

A so-called tandem type color printer is an example of a conventionally known image forming apparatus, in which a photosensitive drum for producing a monochrome (black) image and photosensitive drums for producing three color (cyan, magenta, yellow) images are arranged generally in line. For the sake of simplicity in the following discussion of the invention, the photosensitive drum for producing the monochrome image and the photosensitive drums for producing the color images are referred to as the "monochrome photosensitive drum" and "color photosensitive drums", respectively.

This kind of color printer is provided with an transfer belt device including an endless transfer belt which is so disposed as to contact curved outer surfaces of the aforementioned four photosensitive drums, transfer rollers which are mounted in opposed relation with and are pressed against the corresponding photosensitive drums with the transfer belt passing in between the photosensitive drums and the transfer rollers in order to transfer toner images formed on the photosensitive drums to the transfer belt, and a tension roller which is placed in contact with a surface of the transfer belt exerting specific tension thereon.

Generally in color printers, black toner is used more often compared to color toners. One problem of the conventional color printers is that small quantities of the color toners are consumed even in monochrome print mode, because the color photosensitive drums rotate even during monochrome printing. It has therefore been desired that the photosensitive drums be stopped and kept out of contact with the transfer belt in the monochrome print mode.

One conventional approach to the solution of this problem is described in Japanese Unexamined Patent Publication No. 2002-99132, for example. An arrangement proposed in this Publication is a so-called 3-color removal mechanism built in an image forming apparatus, in which transfer rollers mounted in opposed relation to corresponding color photosensitive drums are made movable toward and away from the color photosensitive drums so that the transfer belt is switched between a state where the transfer belt is positioned in contact with the color photosensitive drums and a state where the transfer belt is positioned apart from the color photosensitive drums.

In the image forming apparatus thus structured, the tension roller is made swingable in a direction perpendicular to an axial direction thereof and, making such swing motion, the tension roller continuously exerts specific tension on the transfer belt even when the transfer belt is displaced as a result of movement of the transfer rollers.

If the longitudinal axis of the tension roller fluctuates due to the swing motion thereof in the image forming apparatus, contact pressure exerted between the tension roller and the transfer belt would vary along the axial direction of the tension roller, causing risk of an image transfer failure.

SUMMARY OF THE INVENTION

It is an object of the present invention to provide an transfer belt device which can prevent the aforementioned image transfer failure problem and an image forming apparatus provided with such transfer belt device.

To achieve this object of the invention, an transfer belt device includes an endless transfer belt capable of going into contact with peripheral surfaces of a monochrome photosensitive drum and a plurality of color photosensitive drums, all of the photosensitive drums being arranged generally in line, a driving roller for turning the transfer belt mounted thereon, a driven roller driven to rotate when the transfer belt also mounted on the driven roller is turned by the driving roller, a frame in which the driving roller and the driven roller are mounted, a plurality of transfer rollers so disposed in face to face relation with the corresponding photosensitive drums with the transfer belt passing in between as to force the transfer belt against the photosensitive drums, a roller support swingably mounted in the frame and supporting the transfer rollers disposed in face to face relation with the corresponding color photosensitive drums, a cam driving shaft rotatably mounted in the frame and fitted with a cam, the cam having capability of swinging the roller support to move the transfer rollers, disposed in face to face relation with the corresponding color photosensitive drums, toward and apart from the color photosensitive drums, to thereby switch the transfer belt and the color photosensitive drums between a state in which the transfer belt is in contact with the color photosensitive drums and a state in which the transfer belt is out of contact with the color photosensitive drums, a tension roller kept in contact with a surface of the transfer belt to exert predetermined tension on the transfer belt, and a pivotal axis on which the tension roller is swingably supported, the pivotal axis being common with the cam driving shaft.

These and other objects, features and advantages of the invention will become more apparent upon a reading of the following detailed description in conjunction with the accompanying drawings.

DETAILED DESCRIPTION OF THE PREFERRED EMBODIMENTS

A preferred embodiment of the present invention is now described in detail with reference to the accompanying drawings.

Figure 1:
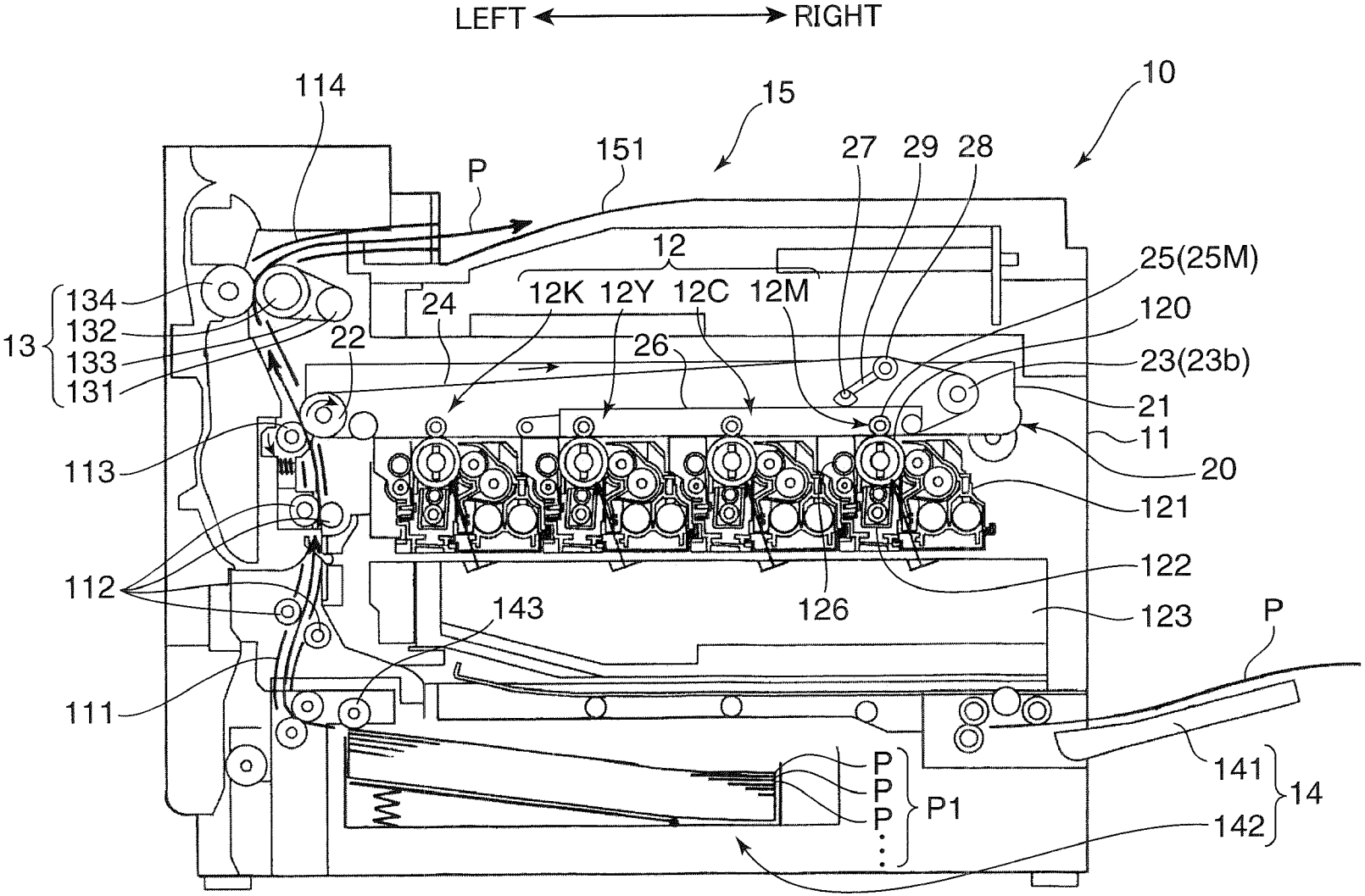
FIG. 1 is a frontal cross-sectional view showing the overall structure of a printer according to an embodiment of the invention.
Figure 2:
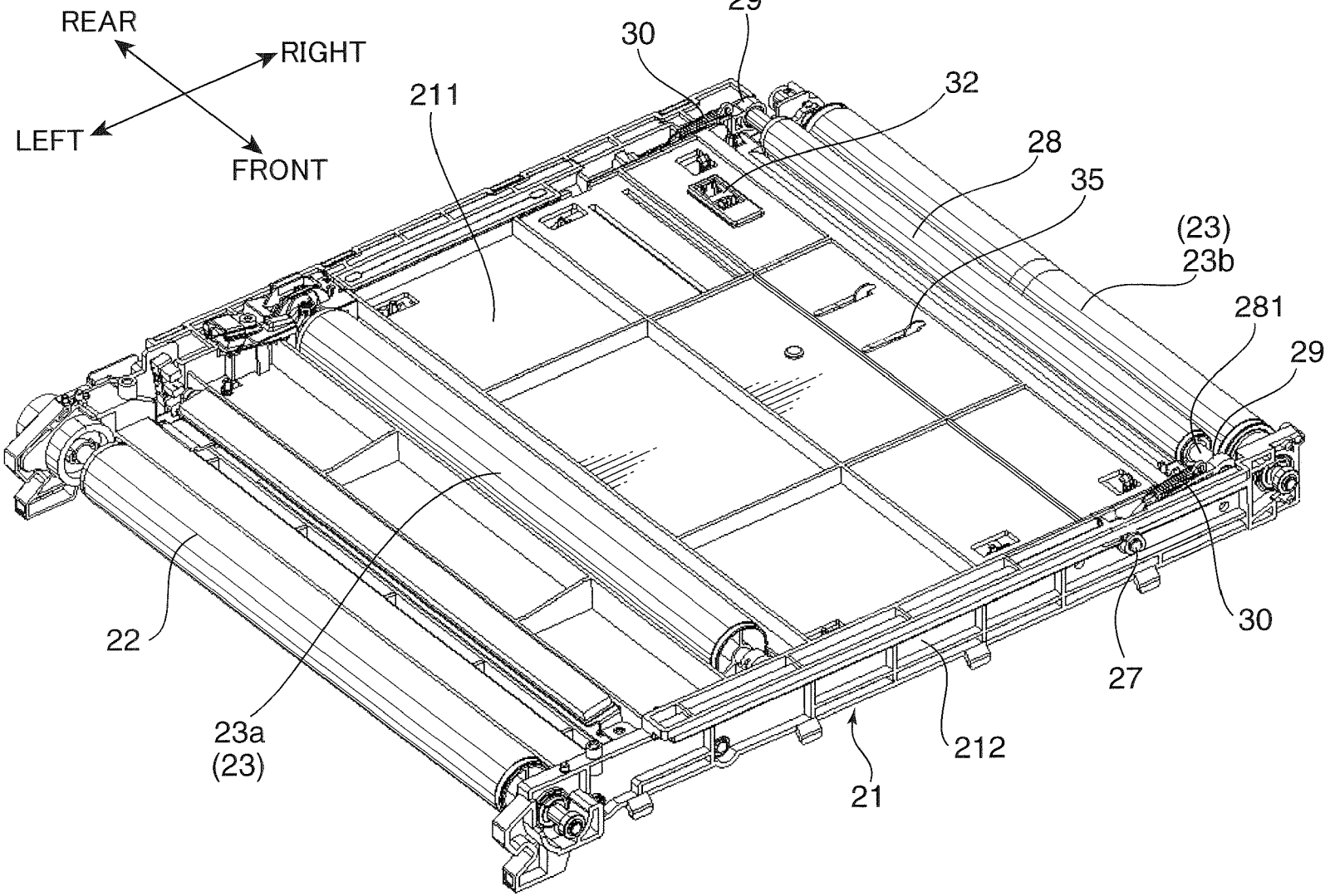
FIG. 2 is a perspective view of an intermediate image transfer unit of the printer as viewed diagonally downward from a front left side thereof.
Figure 3:
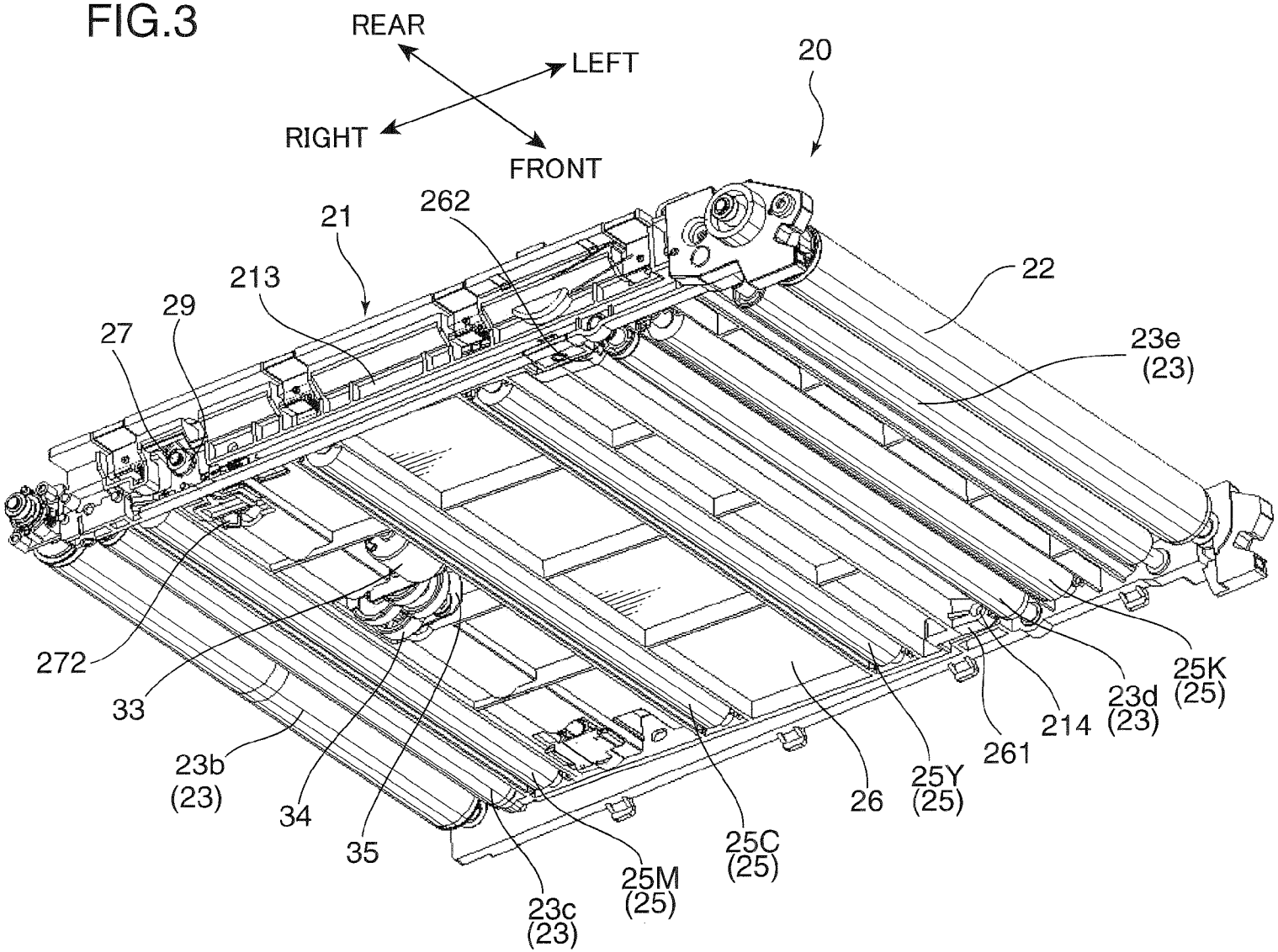
FIG. 3 is a perspective view of the intermediate image transfer unit of the printer as viewed diagonally upward from a rear left side thereof.
Figure 4:
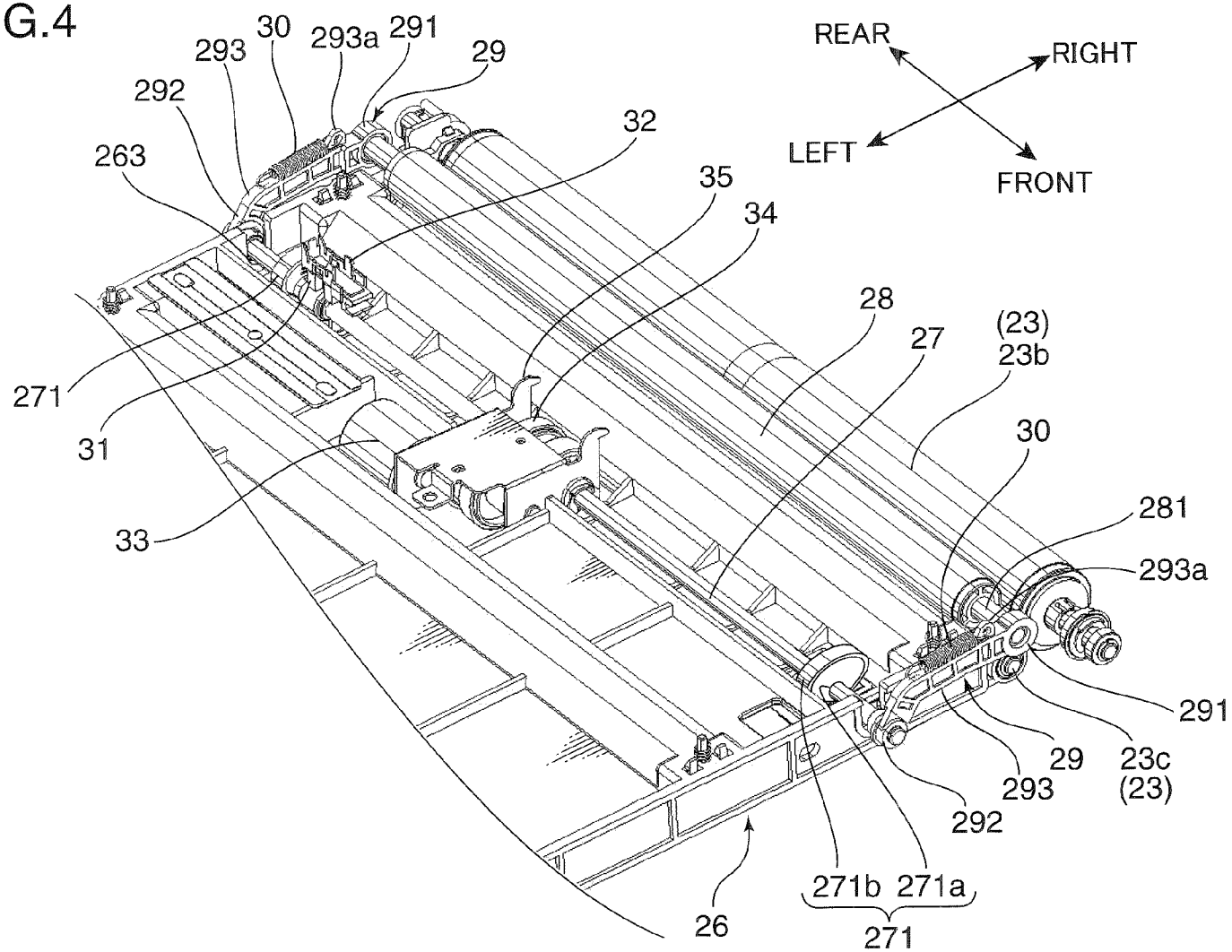
FIG. 4 is a perspective view showing the structure of a principal portion of the intermediate image transfer unit in a surrounding area of a cam driving shaft thereof.
Figure 5:
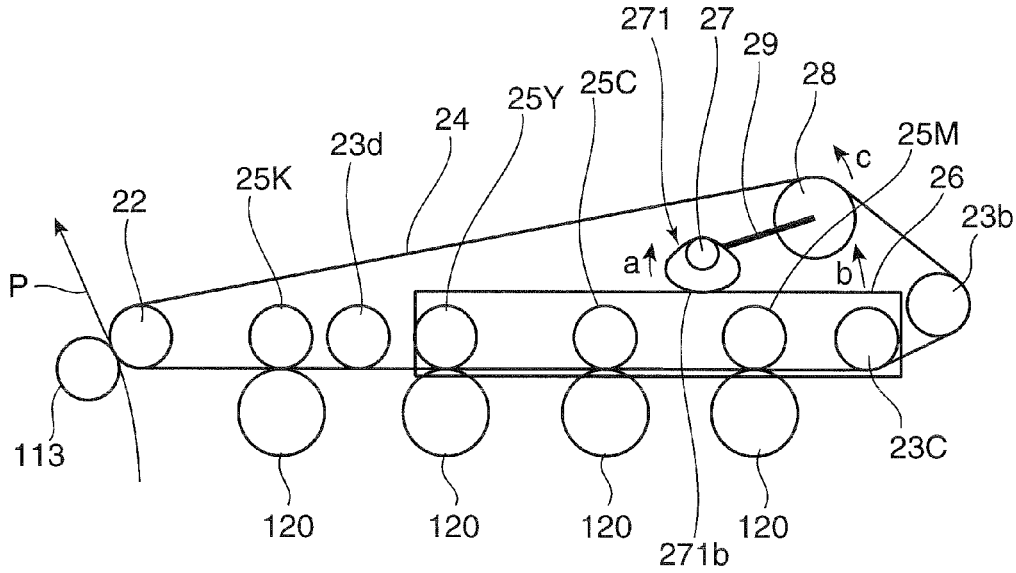
FIG. 5 is an explanatory diagram schematically showing a state of the intermediate image transfer unit in color print mode.
Figure 6:
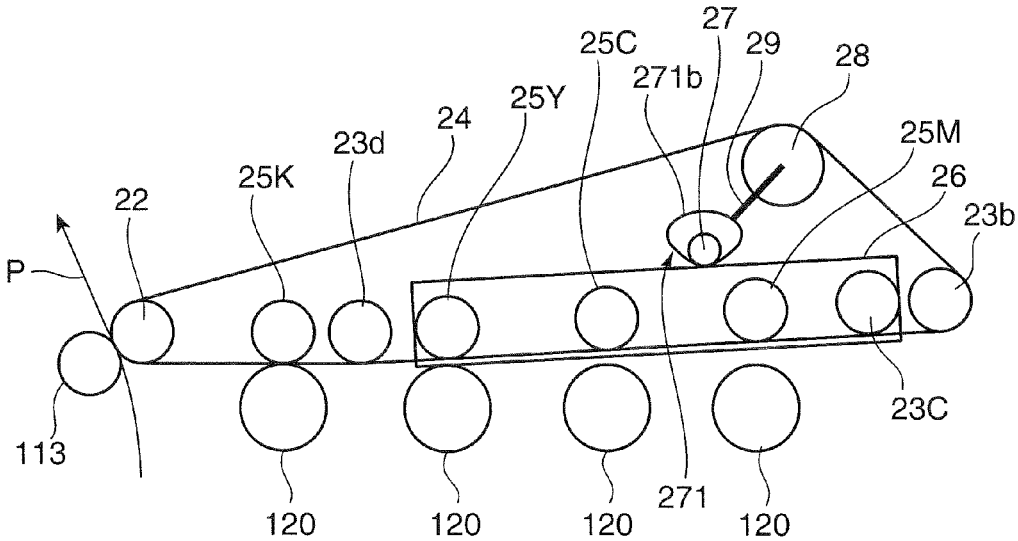
FIG. 6 is an explanatory diagram schematically showing a state of the intermediate image transfer unit in monochrome print mode.

FIG. 1 is a frontal cross-sectional view showing the overall structure of a printer 10 according to the embodiment of the invention, FIGS. 2 and 3 are perspective views of an intermediate image transfer unit 20 of the printer 10, FIG. 4 is a perspective view showing the structure of the intermediate image transfer unit 20 in a surrounding area of a cam driving shaft 27 thereof, and FIGS. 5 and 6 are explanatory diagrams schematically showing states of the intermediate image transfer unit 20 in color and monochrome print modes. In the beginning, the internal structure of the printer (image forming apparatus) 10 of the embodiment is generally described. It is to be noted that FIG. 1 shows a state in which a later-described roller support 26 is in a depressed position, whereas FIG. 2 shows a state in which the roller support 26 is in a released position.

As shown in FIG. 1, the printer 10 of the embodiment includes a generally boxlike apparatus body 11 which is provided inside with an image forming unit 12 for forming an image based on image information fed from an external device like a computer, a fixing unit 13 for fixing the image formed by the image forming portion 12 and then transferred on a sheet P, and a paper storage unit 14 for storing sheets P. The apparatus body 10 is further provided at its top with a sheet delivery unit 15 where each sheet P carrying the fixed image is discharged.

Provided at an appropriate location on a top surface of the apparatus body 11 is an unillustrated operating panel which permits a user to enter output conditions for a sheet P. A power on/off key, a start button and keys used for entering various settings including the output conditions are furnished on the operating panel.

The image forming unit 12 is for forming toner images on each sheet P fed from the paper storage unit 14. The image forming unit 12 includes a magenta image forming unit 12M which uses a magenta developer (toner), a cyan image forming unit 12C which uses a cyan developer, a yellow image forming unit 12Y which uses a yellow developer, and a black image forming unit 12K which uses a black developer. The magenta, cyan, yellow and black image forming units 12M, 12C, 12Y, 12K are arranged in this order from upstream side (right side as illustrated in FIG. 1) to downstream side.

The image forming units 12M, 12C, 12Y, 12K each include a photosensitive drum 120 and a developing device 121. The photosensitive drum 120 of the black image forming unit 12K and the photosensitive drums 120 of the magenta, cyan and yellow image forming units 12M, 12C, 12Y of this embodiment correspond to a "monochrome photosensitive drum" and "color photosensitive drums", respectively in this embodiment.

Each of the photosensitive drums 120 forms on a peripheral surface thereof an electrostatic latent image and a visible toner image converted from the electrostatic latent image. An amorphous silicon layer having an extremely smooth finish with excellent rigidity and wear resistance is formed on the peripheral surface of each photosensitive drum 120. The amorphous silicon layer ensures proper formation of the electrostatic latent image and the toner image. While rotating counterclockwise in FIG. 1, the individual photosensitive drums 120 receive the developers from the corresponding developing devices 121.

There is provided a charging device 122 immediately below each of the photosensitive drums 120. Further below the charging device 122 there is provided an exposure unit 123. The peripheral surfaces of the photosensitive drums 120 are uniformly charged by the charging devices 122 and the charged peripheral surfaces of the photosensitive drums 120 are exposed to laser beams corresponding to colors based on image data fed from a computer or the like, whereby electrostatic latent images are formed on the peripheral surfaces of the photosensitive drums 120. As the developing devices 121 supply the developers to the respective photosensitive drums 120 subsequently, the electrostatic latent images on the peripheral surfaces of the photosensitive drums 120 are converted into toner images.

The intermediate transfer unit (transfer belt device) 20 is disposed immediately above the photosensitive drums 120. The intermediate image transfer unit 20 includes an intermediate transfer belt 24 which is tensioned between a driving roller 22 and a plurality (five in this embodiment) of driven rollers 23 (23*a*-23*e*) (refer to FIGS. 2 and 3) in such a manner that the intermediate transfer belt 24 is placed in contact with the peripheral surfaces of the photosensitive drums 120. The driving roller 22 drives the intermediate transfer belt 24 and the driven rollers 23 rotate as the intermediate transfer belt 24 turns. The intermediate transfer belt 24 which turns around the driving roller 22 and the driven rollers 23 in synchronism with rotation of the photosensitive drums 120 is pressed against the peripheral surfaces of the respective photosensitive drums 120 by primary transfer rollers 25 (25M, 25C, 25Y, 25K) provided in one-to-one correspondence with the photosensitive drums 120.

As the intermediate transfer belt 24 turns in this fashion, a magenta toner image is first transferred from the photosensitive drum 120 of the magenta image forming unit 12M to an outer surface of the intermediate transfer belt 24. Next, a cyan toner image is transferred from the photosensitive drum 120 of the cyan imaging unit 12C to the outer surface of the intermediate transfer belt 24 at the same location on the outer surface in a superimposed manner where the magenta toner image has been transferred. Subsequently, a yellow toner image and a black toner image are transferred from the photosensitive drums 120 of the yellow image forming unit 12Y and the black image forming unit 12K, respectively, to the same location on the outer surface of the intermediate transfer belt 24 in a super imposed manner. As a result of this superimposed manner, a color toner image is formed on the outer surface of the intermediate transfer belt 24. The color toner image so formed on the outer surface of the intermediate transfer belt 24 is transferred onto a sheet P fed from the paper storage unit 14.

As will be discussed later, the intermediate image transfer unit 20 of this embodiment includes a 3-color removal mechanism which places the intermediate transfer belt 24 out of contact with the photosensitive drums 120 of the three color image forming units 12M, 12C, 12Y in the monochrome print mode in which color toners are not consumed. The 3-color removal mechanism serves to keep the photosensitive drums 120 of the three color image forming units 12M, 12C, 12Y in a nonrotating state during the monochrome print mode, making it possible to reduce the amount of consumption of color toners.

Provided to the left of each of the photosensitive drums 120 (as illustrated in FIG. 1) is a cleaning device 126 for cleaning the corresponding photosensitive drum 120 by removing residual toner left on the peripheral surface thereof. As the photosensitive drum 120 rotates, a cleaned portion of the peripheral surface of the photosensitive drum 120 by the cleaning device 126 moves toward the charging device 122 and is electrostatically charged again by the charging device 122.

To the left of the image forming unit 12 (as illustrated in FIG. 1), there is formed a sheet transport path 111 extending generally from the bottom to the top of the apparatus body 11. The sheet transport path 111 is provided with pairs of transport rollers 112 located at appropriate positions. As these pairs of transport rollers 112 rotate, a sheet P fed from the paper storage unit 14 is transported toward the intermediate transfer belt 24 which is mounted on the driving roller 22. The sheet transport path 111 is further provided with a secondary transfer roller 113 disposed in contact with the outer surface of the intermediate transfer belt 24 at a position facing the driving roller 22. As the sheet P being transferred is nipped between the intermediate transfer belt 24 and the secondary transfer roller 113 under pressure, the toner image on the intermediate transfer belt 24 is transferred onto the sheet P.

The fixing unit 13 is provided for fixing the toner image, transferred to the sheet P in the image forming unit 12, onto the sheet P and includes a heating roller 131 having a built-in electric heating element serving as a heat source, a fixing roller 132 disposed in face to face relation with the heating roller 131 to the left thereof (as illustrated in FIG. 1), a fixing belt 133 mounted over the fixing roller 132 and the fixing belt 133, and a pressure roller 134 disposed in face to face relation with the fixing roller 132 with the fixing belt 133 passing therebetween.

The sheet P which has been transported to the fixing unit 13 carrying the toner image transferred from the intermediate transfer belt 24 passes between the pressure roller 134 and the fixing belt 133 which is kept at high temperature, whereby the toner image is fixed to the sheet P due to heat supplied from the fixing belt 133.

Upon completion of this fixing process, the sheet P carrying a color image which has been fixed is discharged onto a delivery tray 151 of the sheet delivery unit 15 provided at the top of the apparatus body 11 through a sheet discharge path 114 which extends upward from the top of the fixing unit 13.

The paper storage unit 14 includes a manual feed tray 141 which is configured to be flipped up and down on a right side of the apparatus body 11 (as illustrated in FIG. 1) and a paper cassette 142 which is detachably mounted below the exposure unit 123 within the apparatus body 11 for holding stacked sheets P.

The paper cassette 142 is of a boxlike structure having an upper opening and capable of holding a stack of sheets P1 including sheets P which are picked up and fed through the sheet transport path 111 one after another by a pickup roller 143. The pickup roller 143, when actuated, supplies the sheet P into the sheet transport path 111 by picking up a downstream portion (left end as illustrated in FIG. 1) of the topmost sheet P among the sheet stack P1. As the pairs of transport rollers 112 are actuated, the sheet P is fed through the sheet transport path 111 up to a nip between the secondary transfer roller 113 and the intermediate transfer belt 24 in the image forming unit 12.

Now, the construction of the intermediate image transfer unit 20 of the present embodiment is described. The intermediate image transfer unit 20 includes, in addition to the aforementioned driving roller 22, five driven rollers 23 (23*a*-23*e*), intermediate transfer belt 24, four primary transfer rollers 25 (25M, 25C, 25Y, 25K), a frame 21, a roller support 26, a cam driving shaft 27 fitted with a pair of front and rear cams 271, a tension roller 28 and a pair of front and rear arms 29.

The frame 21 is so structured as to mount the intermediate image transfer unit 20 inside the apparatus body 11 and to support the driving roller 22, the four driven rollers 23*a*, 23*b*, 23*d*, 23*e*, the primary transfer roller 25K mounted along the photosensitive drum 120 of the black image forming unit 12K, the roller support 26 and the cam driving shaft 27.

The roller support 26 supports the three primary transfer rollers 25M, 25C, 25Y mounted respectively along the photosensitive drums 120 of the three color image forming units 12M, 12C, 12Y and the driven roller 23*c*.

There is provided a pair of front and rear pivot shaft holding parts 261, 262 (refer to FIG. 3) at a left end of the roller support 26. These pivot shaft holding parts 261, 262 are supported by a pair of shafts 214 provided on a front side wall 212 and a rear side wall 213 of the frame 21 (the shaft 214 provided on the rear side wall 213 is not illustrated). This arrangement makes the roller support 26 swingable with respect to the frame 21.

The front and rear cams 271 are provided close to both ends of the cam driving shaft 27 (refer to FIG. 4) and serves to allow the roller support 26 to swing about the frame 21. Each of the cams 271 includes a shaft fitting part 271*a* mounted on the cam driving shaft 27 and a roller support pressing part 271*b* which is so shaped as to fan out from a central axis of the shaft fitting part 271*a* so that a peripheral surface of the roller support pressing part 271*b* goes into contact with an upper surface of the roller support 26 and forces the same downward.

Both ends of the cam driving shaft 27 are supported by unillustrated bearings provided in the front side wall 212 and the rear side wall 213 of the frame 21. In this embodiment, the front and rear cams 271 for moving the primary transfer rollers 25M, 25C, 25Y toward and apart from the corresponding photosensitive drums 120 are mounted on the cam driving shaft 27, where the primary transfer rollers 25M, 25C, 25Y need to be positioned with high accuracy with a view to providing improved image transfer accuracy. Accordingly, the cam driving shaft 27 is positioned with extremely high accuracy in relation to the frame 21. The cam driving shaft 27 is connected to a cam shaft driving motor 33 via a driving gear train 34. The cam shaft driving motor 33 and the driving gear train 34 are attached to a top surface 211 of the frame 21 by means of a motor bracket 35.

The cam shaft driving motor 33 is driven under the control of an unillustrated controller having a print mode decision block which determines in advance whether a current print job is to be performed in the monochrome print mode or the color print mode.

With the aid of the controller and the cam shaft driving motor 33, the cam driving shaft 27 is controllably turned so that the roller support pressing part 271*b* takes a downward oriented position where the roller support pressing part 271*b* is so turned as to be positioned generally immediately below the shaft fitting part 271*a* and also the roller support pressing part 271*b* takes an upward oriented position where the roller support pressing part 271*b* is so turned as to be positioned generally immediately above the shaft fitting part 271*a*. When set in the downward oriented position, the roller support pressing part 271*b* of each cam 271 forces the roller support 26 down to the depressed position so that the primary transfer rollers 25 (25M, 25C, 25Y) are moved toward the corresponding photosensitive drums 120, thereby placing the intermediate transfer belt 24 in contact with the photosensitive drums 120. When set in the upward oriented position, on the other hand, the roller support pressing part 271*b* of each cam 271 forces the roller support 26 up to the released position so that the primary transfer rollers 25 (25M, 25C, 25Y) are moved apart from the corresponding photosensitive drums 120, thereby placing the intermediate transfer belt 24 out of contact with the photosensitive drums 120.

There is formed a pair of front and rear cutouts 263 in the roller support 26 to prevent the roller support 26 from interfering with the cam driving shaft 27 when pivoting.

In this embodiment, the tension roller 28 is positioned generally immediately above the primary transfer roller 25M for the magenta image forming unit 12M. The tension roller 28 is held in contact with an inner surface of the intermediate transfer belt 24 and applies specific tension to the intermediate transfer belt 24 by forcing the same outward.

The tension roller 28 is provided with a roller shaft 281 extending in a direction perpendicular to a turning direction of the intermediate transfer belt 24. Both ends of the roller shaft 281 are supported by the pair of front and rear arms 29 in such a fashion that the roller shaft 281 can swing in a direction perpendicular to the axis of the roller shaft 281 with the aid of the pair of arms 29.

In this embodiment, the two arms 29 are pivotably joined to the cam driving shaft 27 which serves to provide a pivotal axis for the tension roller 28. This means that the pivotal axis of the tension roller 28 is common with a longitudinal axis of the cam driving shaft 27. Each of the arms 29 includes a roller shaft joint portion 291 connected to one end of the roller shaft 281, a cam shaft joint portion 292 connected to one end of the cam driving shaft 27, and an interconnect portion 293 connecting the roller shaft joint portion 291 and the cam shaft joint portion 292 to each other. The interconnect portion 293 has an arm-side spring fitting part 293*a* where one end of a below-mentioned tension spring 30 is fitted.

The individual arms 29 are always biased by the tension springs 30 so that the tension roller 28 remains in contact with the inner surface of the intermediate transfer belt 24, applying an outward tension to the intermediate transfer belt 24. The other end of each tension spring 30 is fitted to an unillustrated frame-side spring fitting part provided in the side wall 212 (213) of the frame 21. It is to be noted that biasing devices other than the tension springs 30 may be substituted therefor. For example, the cam driving shaft 27 may be provided with a coiled torsion spring instead of the tension springs 30 to keep the tension roller 28 in contact with the inner surface of the intermediate transfer belt 24, making it possible to apply an outward oriented tension to the intermediate transfer belt 24.

At the rear end of the cam driving shaft 27, there is provided a cam position sensing element 272 for detecting the rotational position of the cam driving shaft 27, or the position (upward or downward oriented position) of the cams 271 (See FIG. 3). A cam position sensor 31 for detecting a signal from the cam position sensing element 272 is mounted on the top surface 211 of the frame 21 by means of a sensor bracket 32 (See FIG. 4).

The roller support 26 and the cam driving shaft 27 fitted with the cams 271 together constitute the 3-color removal mechanism of the present embodiment.

In the intermediate image transfer unit 20 thus configured, the pair of cams 271 are set in the downward oriented position during the color print mode as shown in FIG. 5. In this case, the roller support 26 is forced down to the depressed position to hold the intermediate transfer belt 24 in contact with the photosensitive drums 120 of the three color image forming units 12M, 12C, 12Y, so that toner images of different colors are transferred to the intermediate transfer belt 24 one on top of another in a superimposed manner.

When the printer 10 is switched from the color print mode to the monochrome print mode, the cam driving shaft 27 is turned as shown by an arrow "a" in FIG. 5 so that the cams 271 turn to the upward oriented position, thereby moving the roller support 26 to the released position as shown by an arrow "b" in FIG. 5. Since the intermediate transfer belt 24 goes out of contact with the photosensitive drums 120 of the three color image forming units 12M, 12C, 12Y as a consequence, it is now possible to stop rotation of the individual photosensitive drums 120 corresponding to the primary transfer rollers 25M, 25C, 25Y.

Also, when the roller support 26 is moved to the released position, a part of the intermediate transfer belt 24 which passes the photosensitive drums 120 is shifted upward so that a downward force exerted on the tension roller 28 from the intermediate transfer belt 24 reduces. Since the tension roller 28 turns counterclockwise about the cam driving shaft 27 as shown by an arrow "c" in FIG. 5 due to a biasing force applied by the tension springs 30, however, the specific tension is applied to the intermediate transfer belt 24 and, therefore, the intermediate transfer belt 24 does not slacken.

When the printer 10 is switched from the monochrome print mode to the color print mode, on the contrary, the 3-color removal mechanism works in reverse order. Specifically, when the roller support 26 moves down to the depressed position, the part of the intermediate transfer belt 24 which passes the photosensitive drums 120 is shifted downward by the primary transfer rollers 25 so that a downward force is exerted on the tension roller 28 from the intermediate transfer belt 24. Since the tension roller 28 turns clockwise about the cam driving shaft 27, however, the specific tension is applied to the intermediate transfer belt 24.

As the pair of arms 29 supporting the tension roller 28 is pivotably joined to the cam driving shaft 27 in this embodiment, it is possible to prevent the tension roller 28 from being displaced in the axial direction due to swing motion of the tension roller 28.

According to the embodiment, there are provided the cams 271 for moving the primary transfer rollers 25, which need to be positioned with high accuracy to achieve improved image transfer accuracy, toward and apart from the corresponding photosensitive drums 120 as discussed earlier, so that the cam driving shaft 27 is positioned with high accuracy in the frame 21. Also, since the cam driving shaft 27 provides the pivotal axis for swingably supporting the tension roller 28, it is possible to prevent the tension roller 28 from fluctuating due to the swing motion of the tension roller 28. In other words, it is possible to prevent the tension, applied to the intermediate transfer belt 24 from the tension roller 28, from varying in the longitudinal direction of the tension roller 28. Accordingly, it is possible to keep the intermediate transfer belt 24 from running in meandering motion due to fluctuating movement of the tension roller 28 in this structure, it is possible to prevent image transfer failures.

Furthermore, since the arms 29 for swingably supporting the tension roller 28 is pivotably supported by the cam driving shaft 27 as discussed so far in the foregoing embodiment, it is possible to cause the tension roller 28 to swing in an orbit about the cam driving shaft 27. This arrangement helps stabilize the swing motion of the tension roller 28, making it possible to prevent the tension roller 28 from fluctuating due to the swing motion of the tension roller 28.

While the foregoing discussion has illustrated the printer 10 according to the preferred embodiment as an example of an image forming apparatus, the invention is not limited to the printer 10 but is widely applicable to various kinds of image forming apparatuses, such as copying machines and facsimile machines.

While the present invention has thus far been described with reference to the illustrative embodiment thereof, principal arrangements and features of the transfer belt device and the image forming apparatus of the invention can be summarized as follows.

An transfer belt device of the invention includes an endless transfer belt capable of going into contact with peripheral surfaces of a monochrome photosensitive drum and a plurality of color photosensitive drums, all of the photosensitive drums being arranged generally in line, a driving roller for turning the transfer belt mounted thereon, a driven roller driven to rotate when the transfer belt also mounted on the driven roller is turned by the driving roller, a frame in which the driving roller and the driven roller are mounted, a plurality of transfer rollers so disposed in face to face relation with the corresponding photosensitive drums with the transfer belt passing in between as to force the transfer belt against the photosensitive drums, a roller support swingably mounted in the frame and supporting the transfer rollers disposed in face to face relation with the corresponding color photosensitive drums, a cam driving shaft rotatably mounted in the frame and fitted with a cam, the cam having capability of swinging the roller support to move the transfer rollers, disposed in face to face relation with the corresponding color photosensitive drums, toward and apart from the color photosensitive drums, to thereby switch the transfer belt and the color photosensitive drums between a state in which the transfer belt is in contact with the color photosensitive drums and a state in which the transfer belt is out of contact with the color photosensitive drums, a tension roller kept in contact with a surface of the transfer belt to exert predetermined tension on the transfer belt, and a pivotal axis on which the tension roller is swingably supported, the pivotal axis being common with the cam driving shaft.

In the transfer belt device thus structured, the cam driving shaft is fitted with the cam for moving the transfer rollers, which need to be positioned with high accuracy to achieve improved image transfer accuracy, toward and apart from the corresponding color photosensitive drums, so that the cam driving shaft is positioned with high accuracy in the frame. As the pivotal axis on which the tension roller is swingably supported is common with the axis of the cam driving shaft in this structure, it is possible to prevent the tension roller from fluctuating irregularly due to swing motion thereof. Since the transfer belt can be kept from running in meandering motion in this structure, it is possible to prevent image transfer failures.

In one aspect of the invention, the tension roller is preferably supported swingably in a direction perpendicular to a longitudinal axis of the tension roller.

Since the tension roller is supported on the aforementioned pivotal axis swingably in the direction perpendicular to the longitudinal axis of the tension roller in this structure, it is possible to prevent the tension roller from fluctuating.

In another aspect of the invention, the transfer belt device further includes an arm supporting the tension roller in such a manner that the tension roller is swingable in the perpendicular direction. The arm is pivotably supported by the cam driving shaft.

Since the arm swingably supporting the tension roller is pivotably supported by the cam driving shaft in this structure, it is possible to cause the tension roller to swing in an orbit about the cam driving shaft. This arrangement helps stabilize the swing motion of the tension roller, making it possible to prevent the tension roller from fluctuating due to the swing motion thereof.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

This application is based on Japanese Patent Application Nos. 2008-015935 filed on Jan. 28, 2008, respectively, the contents of which are hereby incorporated by reference.

What is claimed is:

1. A transfer belt device comprising:

an endless transfer belt capable of going into contact with peripheral surfaces of a monochrome photosensitive drum and a plurality of color photosensitive drums, all of the photosensitive drums being arranged generally in line;

a driving roller for turning the transfer belt mounted thereon;

a driven roller driven to rotate when the transfer belt also mounted on the driven roller is turned by the driving roller;

a frame in which the driving roller and the driven roller are mounted;

a plurality of transfer rollers so disposed in face to face relation with the corresponding photosensitive drums with the transfer belt passing in between as to force the transfer belt against the photosensitive drums;

a roller support swingably mounted in the frame and supporting the transfer rollers disposed in face to face relation with the corresponding color photosensitive drums;

a cam driving shaft rotatably mounted in the frame and fitted with a cam, the cam having capability of swinging the roller support to move the transfer rollers, disposed in face to face relation with the corresponding color photosensitive drums, toward and apart from the color photosensitive drums, to thereby switch the transfer belt and the color photosensitive drums between a state in which the transfer belt is in contact with the color photosensitive drums and a state in which the transfer belt is out of contact with the color photosensitive drums;

a tension roller kept in contact with a surface of the transfer belt to exert predetermined tension on the transfer belt; and a pivotal axis on which the tension roller is swingably supported, the pivotal axis being common with the cam driving shaft.

2. The transfer belt device according to claim 1, wherein the tension roller is so supported on the pivotal axis as to be swingable in a direction perpendicular to a longitudinal axis of the tension roller.

3. The transfer belt device according to claim 1, wherein the tension roller has a roller shaft extending in a direction perpendicular to a turning direction of the transfer belt, and the tension roller is swingably supported on the pivotal axis such that the roller shaft of the tension roller is kept perpendicular to the turning direction of the transfer belt.

4. The transfer belt device according to claim 2, further comprising an arm supporting the tension roller in such a manner that the tension roller is swingable in the perpendicular direction, the arm being pivotably supported by the cam driving shaft.

5. An image forming apparatus comprising:

an image forming unit including a monochrome photosensitive drum and a plurality of color photosensitive drums having peripheral surfaces on which toner images are formed, all of the photosensitive drums being arranged generally in line; and a transfer belt device including:

an endless transfer belt capable of going into contact with the peripheral surfaces of the monochrome photosensitive drum and the plurality of color photosensitive drum;

a driving roller for turning the transfer belt mounted thereon;

a driven roller driven to rotate when the transfer belt also mounted on the driven roller is turned by the driving roller;

a frame in which the driving roller and the driven roller are mounted;

a plurality of transfer rollers so disposed in face to face relation with the corresponding photosensitive drums with the transfer belt passing in between as to force the transfer belt against the photosensitive drums;

a roller support swingably mounted in the frame and supporting the transfer rollers disposed in face to face relation with the corresponding color photosensitive drums;

a cam driving shaft rotatably mounted in the frame and fitted with a cam, the cam having capability of swinging the roller support to move the transfer rollers, disposed in fact to face relation with the corresponding color photosensitive drums, toward and apart from the color photosensitive drums, to thereby switch the transfer belt and the color photosensitive drums between a state in which the transfer belt is in contact with the color photosensitive drums and a state in which the transfer belt is out of contact with the color photosensitive drums;

a tension roller kept in contact with a surface of the transfer belt to exert predetermined tension on the transfer belt; and a pivotal axis on which the tension roller is swingably supported, the pivotal axis being common with the cam driving shaft.

6. The image forming apparatus according to claim 5, wherein the tension roller is supported on the pivotal axis so to be swingable in a direction perpendicular to a longitudinal axis of the tension roller.

7. The image forming apparatus according to claim 5, wherein the tension roller has a roller shaft extending in a direction perpendicular to a turning direction of the transfer belt, and the tension roller is swingably supported on the pivotal axis such that the roller shaft of the tension roller is kept perpendicular to the turning direction of the transfer belt.

8. The image forming apparatus according to claim 6, further comprising an arm supporting the tension roller in such a manner that the tension roller is swingable in the perpendicular direction, the arm being pivotally supported by the cam driving shaft.

* * * * *